US005563690A

United States Patent [19]

Hasegawa et al.

[11] Patent Number: 5,563,690

[45] Date of Patent: Oct. 8, 1996

[54] DEVELOPING SLEEVE HAVING AN OUTER CERAMIC LAYER DEVELOPING DEVICE FOR DEVELOPING ELECTROSTATIC LATENT IMAGES, AND IMAGE-FORMING APPARATUS

[75] Inventors: Keisuke Hasegawa, Tokyo; Keishi Ohsawa, Yokohama, both of Japan

[73] Assignee: Canon Kabushiki Kaisha, Tokyo, Japan

[21] Appl. No.: 252,259

[22] Filed: May 31, 1994

[51] Int. Cl.[6] ..... G03G 15/06

[52] U.S. Cl. ..... 355/259

[58] Field of Search ..... 355/251, 253, 355/259; 118/656, 657, 658, 661

[56] References Cited

U.S. PATENT DOCUMENTS

| | | | |
|---|---|---|---|
| 4,989,044 | 1/1991 | Nishimura et al. | 355/251 |
| 5,189,476 | 2/1993 | Anno et al. | 355/259 |
| 5,319,337 | 6/1994 | Matsunari et al. | 355/251 X |
| 5,322,970 | 6/1994 | Behe et al. | 355/259 X |

FOREIGN PATENT DOCUMENTS

| | | | |
|---|---|---|---|
| 61-140967 | 6/1986 | Japan | 355/251 |
| 62-70877 | 4/1987 | Japan | 355/251 |
| 62-95563 | 5/1987 | Japan | 355/251 |
| 1-257880 | 10/1989 | Japan | 355/251 |
| 3-20764 | 1/1991 | Japan | 355/251 |
| 4-7568 | 1/1992 | Japan | 355/251 |
| 4-143780 | 5/1992 | Japan | 355/251 |
| 4-162060 | 6/1992 | Japan | 355/251 |
| 5-46008 | 2/1993 | Japan | 355/251 |
| 5-107926 | 4/1993 | Japan | 355/251 |
| 5-188771 | 7/1993 | Japan | 355/251 |

*Primary Examiner*—Fred L. Braun

*Attorney, Agent, or Firm*—Fitzpatrick, Cella, Harper & Scinto

[57] ABSTRACT

A developing sleeve used in a developing device of an electrophotographic apparatus is composed of a sleeve base and an electrodeposition coating formed on the surface of the sleeve base. The electrodeposition coating contains an electrodepositable resin and an electroconductivity-controlling powdery matter, which can be a powdery ceramic, with or without a powdery metal. A developing device for developing an electrostatic latent image and an image-forming apparatus including this developing sleeve are disclosed.

101 Claims, 4 Drawing Sheets

DEVELOPING SLEEVE HAVING AN OUTER CERAMIC LAYER DEVELOPING DEVICE FOR DEVELOPING ELECTROSTATIC LATENT IMAGES, AND IMAGE-FORMING APPARATUS

BACKGROUND OF THE INVENTION

1. Field of the Invention

The present invention relates to a developing sleeve of a developing device of an electrophotographic image-forming apparatus such as a copying machine and a laser beam printer.

The present invention also relates to a developing apparatus employing the developing sleeve for developing an electrostatic latent image.

The present invention further relates to an image-forming apparatus employing the developing apparatus.

2. Related Background Art

The electrophotographic image-forming apparatus such as copying machines and laser beam printers visualizes an electrostatic latent image formed on an image-holding member by developing it as a toner image by means of a developing device.

Such a developing device generally employs a developing metal sleeve, and visualizes an electrostatic latent image on an image-holding member by delivering, with the developing sleeve, a developing agent from a developing-agent container to a developing section facing the image-holding member to visualize the electrostatic latent image as a toner image.

The developing agent includes one-component type of developing agents such as one-component magnetic toner and a one-component non-magnetic toner, and two-component type of developing agents employing a non-magnetic toner and a magnetic carrier. The material for the sleeve is selected to meet the properties of the developing agent.

For use of a magnetic toner, a magnetic force-generating means such as a magnet is provided inside the developing sleeve which is made of a non-magnetic metal. The surface of the sleeve is roughened so as to be suitable for retaining and delivering the toner and to cause sufficient frictional electrification. On the development, a developing bias voltage, which may be AC, DC, or superposition thereof, is applied to the developing sleeve to conduct satisfactory development. The developing sleeve therefor is made of an electroconductive metal.

The conventional developing sleeves have disadvantages below.

When the developing apparatus is driven at a high speed with a high drive frequency, the surface roughness, namely the fine projections and recesses formed on the surface of the sleeve, is gradually reduced in the course of a long-term of use, which will cause deterioration of the toner delivering performance and of the toner electrification performance of the sleeve to result in lowering of density of the copied image.

In a non-contact developing system in which the developing sleeve does not brought into contact with the image-holding member, thermal distortion of the developing sleeve gives adverse effects on the copied image. The thermal distortion causes the change of the distance between the developing sleeve and the image-holding member, namely an S-D distance, affecting the developing performance and the density of the copied image.

The disadvantages are reduced by using a less thermally deteriorating material or higher thermal conductive material as the base material of the developing sleeve. Generally, aluminum is used therefor in consideration of the cost. The aluminum, however, is less abrasion-resistant, and is not suitable for the developing sleeve for which high durability is required.

To offset the above disadvantages, the surface of the developing sleeve is usually coated with a suitable material. However, the roughness of the surface and the durability of the surface is difficult to simultaneously achieve without rise of production cost.

For instance, a ceramic material which is frequently used as the coating material has a high hardness and is less workable although it is superior in durability. Therefore, it is highly difficult to form a rough coating surface of the ceramic material. A thin and uniform coating layer of the ceramic is required for electrification of the toner, since the ceramic is an electric insulator. However, the thin and uniform film of the ceramic cannot be readily formed at a low production cost.

SUMMARY OF THE INVENTION

The present invention intends to provide a developing sleeve for developing an electrostatic latent image which is free of the aforementioned disadvantages, and which has a uniform coating layer with a satisfactorily roughened surface and has excellent properties of high abrasion resistance, well-controlled electroconductivity, excellent toner-delivering performance, and ease of frictional electrification.

The present invention further intends to provide a developing device for developing an electrostatic latent image employing the above developing sleeve.

The present invention still further intends to provide an image-forming apparatus employing the above developing device.

The developing sleeve of the present invention comprises a sleeve base, and an electrodeposition coating film formed on the surface thereof and containing a electroconductivity-controlling powdery matter.

The developing device for developing an electrostatic latent image of the present invention comprises a developing sleeve for holding a toner and delivering the toner to a developing section facing an image-holding member, the developing sleeve comprising a sleeve base, and an electrodeposition coating film formed on the surface thereof and containing a electroconductivity-controlling powdery matter.

The image-forming apparatus of the present invention comprises an image-holding member for holding an electrostatic latent image, and a developing device for developing the electrostatic latent image held on the image-holding member, the developing device comprising a developing sleeve for holding a toner and delivering the toner to a developing section facing an image-holding member, the developing sleeve comprising a sleeve base, and an electrodeposition coating film formed on the surface thereof and containing a electroconductivity-controlling powdery matter.

DESCRIPTION OF THE PREFERRED EMBODIMENTS

Figure 1:
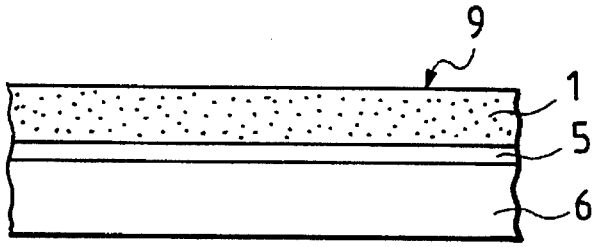
FIG. 1 is a cross-sectional view of a surface portion of a developing sleeve of an embodiment of the present invention.

After comprehensive investigation by the inventors of the present invention, a developing sleeve was completed which has a uniform coating layer with a satisfactorily roughened surface and has excellent properties of high abrasion resistance, well-controlled electroconductivity, excellent toner-delivering performance, and ease of frictional electrification. The developing sleeve is prepared by an electrodeposition of a paint composed of an electrodepositable resin and an electroconductivity-controlling powdery matter on a metallic or non-metallic sleeve base. The electroconductivity-controlling powdery matter contained in the deposition coating film of the present invention is preferably a powdery ceramic in view of the improvement of abrasion resistance of the coating film. More preferable therefor is a powdery ceramic which is plated with a metal for imparting to the coating film an excellent frictional electrification property in addition to the improved abrasion resistance. The electrodeposition coating in the present invention means co-precipitation of an electrodeposition paint with a powdery matter dispersed therein by electrophoresis. Thereby the powdery matter is uniformly dispersed in the electrically deposited resin in the coating film formed on the surface of a base of a developing sleeve.

The electrodeposition coating film 1 on the sleeve base of the present invention contains an electroconductivity-controlling powdery matter. Such a electrodeposition coating film 1 may be formed by electrically depositing an electrodeposition paint composed of a electrodepositable resin and an electroconductivity-controlling powdery matter dispersed therein on the sleeve base.

The powdery ceramic has preferably an average particle diameter ranging from 0.1 to 10.0 μm, more preferably from 0.3 to 3.0 μm. In the range of the average diameter of less than 0.1 μm, the metal-plating on the powdery ceramic becomes costly, whereas in the range of the average diameter of more than 10.0 μm, dispersibility of the powdery ceramic becomes low.

The particle diameter of the powdery ceramic can be measured by using a centrifugal sedimentation type of particle diameter distribution tester, specifically SACP-3 made by Shimadzu Corporation.

The metal for plating the powdery ceramic surface includes Ag, Ni, and Cu. Of these metals, electroless-plated Ni and Cu are preferred from the cost. The thickness of the metal-plating on the surface of the powdery ceramic is preferably in the range of from 0.05 to 0.9 μm, more preferably from 0.1 to 0.5 μm.

The electrodeposition paint may be of an anion type or a cation type. The electrodepositable resin includes generally known low-temperature curing resins such as acrylic-melamine resins, acrylic resins, epoxy resins, urethane resins, and alkyd resins.

The mixing ratio of the powdery ceramic in the electrodeposition paint ranges preferably from 5 to 20 parts by weight based on 100 parts by weight of the electrodepositable resin. The powdery ceramic incorporated within this range gives uniform and excellent abrasion resistance throughout the electrodeposition coating film.

The powdery ceramic may be dispersed in the electrodeposition paint by stirring with a ball mill for about 24 to 35 hours. The dispersion is then diluted with deionized water to a solid matter content of from 3 to 20% by weight, preferable from 3 to 17% by weight to prepare the deposition paint.

The electrodeposition is conducted with the sleeve base employed as the anode for an anionic paint, or employed as the cathode for a cationic paint under the electrolysis conditions preferably of: liquid temperature of from 20° C. to 25° C., pH of from 8 to 9, application voltage of from 50 to 200 V, current density of from 0.5 to 3 A/dm$^2$, and treating time of from 3 to 6 minutes. After the electrodeposition coating, the sleeve is washed with water, the water is allowed to drip off, and the coating film is cured by heating at a temperature of from 100° C. to 140° C. in an oven for a time of 20 to 180 minutes to complete a powdery ceramic-containing electrodeposition film.

The amount (or the content) of the powdery ceramic co-deposited in the electrodeposition film is preferably in the range of from 5 to 50% by weight, more preferably from 20 to 40% by weight. The co-deposition amount can be measured with a thermogravimetric analyzer.

The thickness of the electrodeposition coating film is preferably not less than 5 μm, more preferably from 7 to 15 μm. With the thickness of 5 μm or more, any desired electroconductivity can be imparted to the electrodeposition coating film on the developing sleeve, and the abrasion resistance can be made uniform and excellent throughout the electrodeposition coating film.

The co-deposition of the powdery ceramic with the resin in the present invention makes the curing reaction complete even at a low curing temperature (110° C.), and the resulting cured electrodeposition coating film has properties as excellent as, or more excellent than the properties of a high-temperature cured film.

FIG. 1 is a cross-sectional view of a surface portion of a developing sleeve of an embodiment of the present invention. The sleeve 9 of this embodiment employs a sleeve-shaped aluminum as the metallic member 6, and thereon an oxide coating layer 5 is formed by anodic oxidation (anodizing) of the aluminum. Using the sleeve base thus prepared, an electrodeposition coating film 1 is formed on the surface of that sleeve base.

Figure 2:
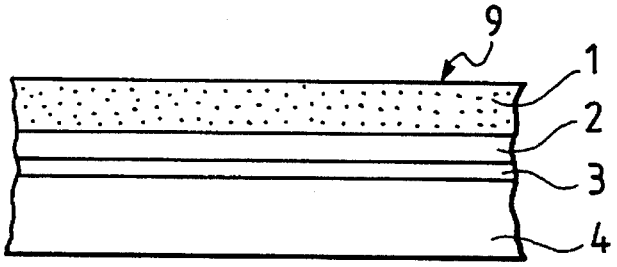
FIG. 2 is a cross-sectional view of a surface portion of a developing sleeve of another embodiment of the present invention.

FIG. 2 is a cross-sectional view of a surface portion of a developing sleeve of another embodiment of the present invention. The sleeve 9 of this embodiment employs a sleeve-shaped ABS resin as the non-metallic member 4. A catalysis layer 3 and a metal-plating layer 2 are sequentially formed on the ABS resin by conducting the steps of applying metal-plating to plastic. Using the sleeve base thus prepared, an electrodeposition coating film 1 is formed on the surface of that sleeve base.

Figure 3:
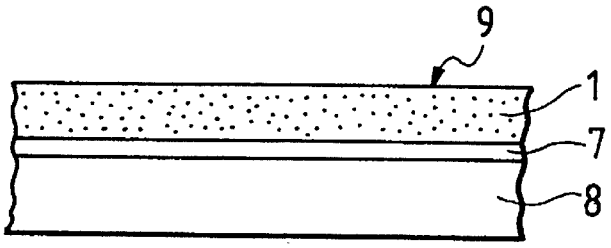
FIG. 3 is a cross-sectional view of a surface portion of a developing sleeve of still another embodiment of the present invention.

FIG. 3 is a cross-sectional view of a surface portion of a developing sleeve of still another embodiment of the present invention. The sleeve 9 of this embodiment employs a sleeve-shaped iron material as the metallic member 8, and thereon, a chemical conversion coating layer 7 is formed. Using the sleeve base thus prepared, an electrodeposition coating film 1 is formed on the surface of that sleeve base.

The sleeve base of the developing sleeve 9 of the present invention is made of either a metallic material such as aluminum and iron or a non-metallic material such as plastics, and the surface is treated for substrate for the electrodeposition coating as shown in FIGS. 1 to 3.

The non-metallic material 4 is not specially limited, and may be a plastic material which is used for a rigid parts, including the aforementioned ABS resins, CF/ABS resins, modified PPE resins, modified PPO resins, and GF/PC resins.

Figure 4:
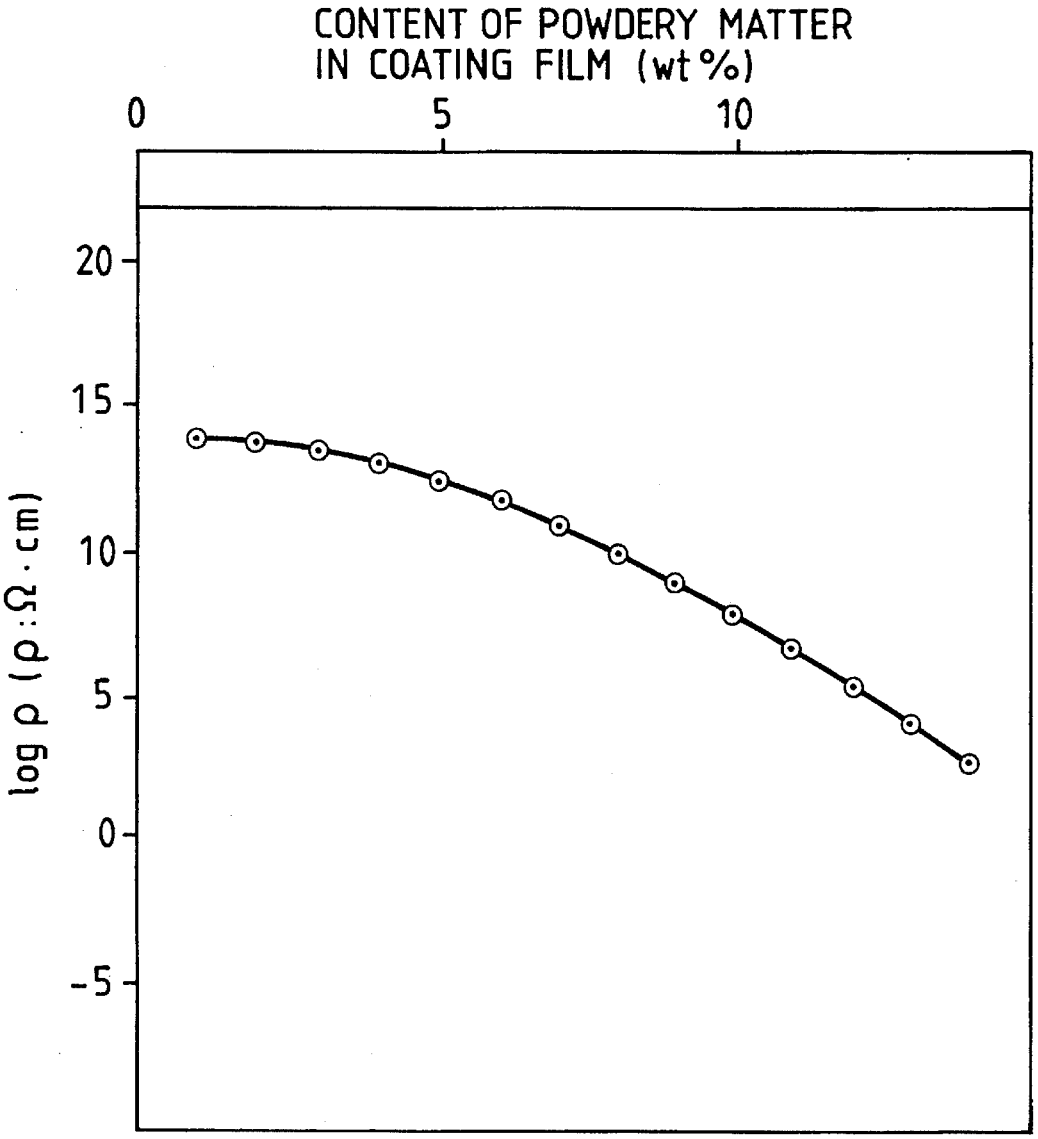
FIG. 4 is a graph showing the dependency of the volume resistivity upon the powdery matter content of a electrodeposition film on the surface of the developing sleeve.

FIG. 4 is a graph showing the volume resistivity of an electrodeposition coating film 1 formed in a thickness of 20 μm on one face of an aluminum 53S test piece (size: 5 cm long ×5 cm wide ×1.0 mm thick), measured with a contact insulation resistance tester, with respect to a powdery ceramic content. The powdery ceramic employed was powdery $Al_2O_3$ having an average particle diameter of 1 μm. Nickel was plated thereon in a thickness of 0.1 μm. The nickel-plated powdery ceramic was mixed with a resin in a ratio of the resin to the metal-plated powdery ceramic of 7:3 by weight to prepare an electrodeposition paint containing an acrylic resin at a content of 12% by weight. The volume resistivity was measured by bringing a 4-point contact type probe into contact with the electrodeposition coating film at a measuring area of 1 $cm^2$.

As shown in FIG. 4, the volume resistivity ρ of the obtained electrodeposition coating film 1 gradually changes with the change of the content of the metal-plated fine powdery $Al_2O_3$. Accordingly, an any desired volume resistivity can be imparted accurately to the developing sleeve 9. Moreover, the electrodeposition coating film 1 is formed uniformly over the entire surface of the developing sleeve 9 because the coating is conducted by electrophoresis in the electrodeposition.

The volume resistivity of the electrodeposition coating film is preferably in the range of from $10^4$ to $10^3$ Ω•cm, more preferably from $10^5$ to $10^{12}$ Ω•cm in the present invention. In the volume resistivity range of higher than $10^{13}$ Ω•cm, the quantity of the frictional electrification is excessive to cause deterioration of the image, whereas in the volume resistivity range of lower than $10^4$ Ω•cm, the quantity of the co-precipitated powdery matter is larger and the quantity of the electrodeposition resin as the binder correspondingly decreases to cause deterioration of the abrasion resistance of the coating film, disadvantageously.

The electrodeposition coating film in the present invention may further contain a powdery metal as the electroconductivity-controlling powdery matter in addition to the aforementioned powdery ceramic. It is explained below.

The electrodeposition coating film containing the powdery ceramic and the powdery metal may be formed on the sleeve by electrodeposition of a paint prepared by mixing an electrodepositable resin, the powdery ceramic, and the powdery metal.

The ultrafine powdery metal material is not specially limited, and includes Ag, Co, Cu, Fe, Mn, Ni, Pd, Sn, and Te. The particle diameter of the powdery metal is preferably in the range of from 0.01 to 5.0 μm, more preferably from 0.01 to 1.0 μm. In the particle diameter range of less than 0.01 μm, the dispersed particles tend to aggregate secondarily, whereas, in the range of more than 5.0 μm, the dispersion in the deposition coating film 1*a* is less uniform. The ultrafine powdery metal is preferably prepared, for example, by thermal plasma evaporation.

The particle diameter of the powdery metal can be measured by a centrifugal sedimentation type of particle size distribution tester in the same manner as in the measurement of the powdery ceramic, specifically with SACP-3 in the present invention.

As mentioned above, the average particle diameter of the powdery ceramic is preferably in the range of from 0.1 to 10.0 μm, preferably from 0.3 to 3.0 μm. The metal for plating the powdery ceramic includes Ag, Ni, and Cu. The thickness of the plating is usually in the range of from 0.05 to 0.9 μm, preferably from 0.1 to 0.5 μm. Further, the electrodeposition paint may be either of an anion type or of a cation type. The electrodepositable resin includes generally known low-temperature curing resins such as acrylic-melamine resins, acrylic resins, epoxy resins, urethane resins, and alkyd resins.

The ratio of the powdery ceramic to the ultrafine powdery metal mixed in the electrodeposition paint is in the range of from 30 to 300 parts by weight of the powdery ceramic with respect to 100 parts by weight of the ultrafine powdery metal.

The total amount of the ultrafine powdery metal and the ceramic metal in the electrodeposition paint is preferably in the range of from 5 to 40 parts by weight, more preferably from 5 to 20 parts by weight based on 100 part by weight of the electrodepositable resin. If the amount is less than 5 parts by weight, the electroconductivity of the formed electrodeposition coating film is insufficient, whereas, if the amount is more than 40 parts by weight, the adhesion of the electrodeposition coating film onto the sleeve is insufficient. The electroconductivity of the electrodeposition coating film can be controlled to any desired level by adjusting the mixing amount of the powdery metal and the powdery ceramic in the above specified range.

The co-deposition of the ultrafine powdery metal and the powdery ceramic in the electrodeposition coating film is confirmed by an X-ray microanalyzer, and the content, or the co-deposition amount, in the electrodeposition coating film is measured by thermogravimetric analysis.

The ultrafine powdery metal and the powdery ceramic are dispersed in the electrodeposition paint by mixing with a ball mill for about 24 to 35 hours, then the dispersion is diluted with deionized water to a solid matter content in the range of preferably from 3 to 20% by weight, more preferably from 3 to 17% by weight to prepare the electrodeposition paint in the present invention.

The electrodeposition is conducted, as described for the case where the ultrafine powdery metal is not employed, with the sleeve base employed as the anode for an anionic paint, or employed as the cathode for a cationic paint under the electrolysis conditions preferably of: liquid temperature of from 20° C. to 25° C., pH of from 8 to 9, application voltage of from 5 to 200 V, current density of from 0.5 to 3 $A/dm^2$, treating time of from 3 to 6 minutes. After the electrodeposition, the sleeve is washed with water, the water is allowed to drip off, and the coating film is cured by heating at a temperature of from 100° C. to 140° C. in an oven for a time of from 20 to 180 minutes to complete a powdery ceramic-containing electrodeposition film.

The co-deposition amount (or the content) of the powdery metal and the powdery ceramic in the deposition film is preferably in the range of from 5 to 50% by weight, more preferably from 20 to 40% by weight.

The thickness of the electrodeposition coating film containing the powdery metal and the powdery ceramic is preferably not less than 5 μm, more preferably from 7 to 15 μm as in the case where only the powdery ceramic solely is contained. With the thickness of 5 μm or more, any desired electroconductivity can be imparted to the electrodeposition coating film 1 on the developing sleeve 9, and the abrasion resistance can be made uniform and excellent throughout the electrodeposition coating film 1*a*.

The co-deposition of the powdery ceramic and the powdery metal with the resin in the present invention makes the curing reaction complete even at a low curing temperature (110° C.), and the resulting cured electrodeposition coating film has properties as excellent as, or more excellent than the properties of a high-temperature cured film. In particular, the incorporation of the powdery metal makes easier the control of the electroconductivity of the electrodeposition coating film. In other words, the surface of the developing sleeve can be more increased in the degree of freedom of surface control than that containing the powdery ceramic alone because the surface roughness is controlled by the powdery ceramic and the surface resistance can be controlled by the powdery metal.

Figure 7:
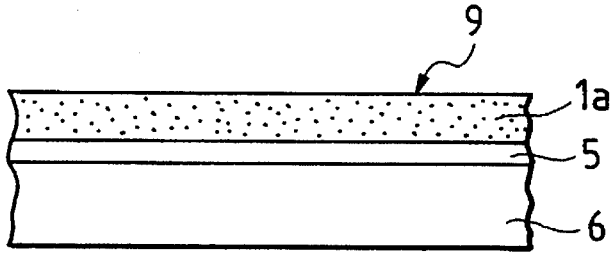
FIG. 7 is a cross-sectional view of a surface portion of a developing sleeve of a further embodiment of the present invention.

FIG. 7 is a cross-sectional view of a surface portion of a developing sleeve of still another embodiment of the present invention. The sleeve 9 of this embodiment employs a sleeve-shaped aluminum as the metallic member 6, and thereon an oxide coating layer 5 is formed by anodic oxidation of the aluminum. Using the sleeve base thus prepared, an electrodeposition coating film la containing a metal-plated powdery ceramic and a powdery metal is formed on the surface of that sleeve base.

Figure 8:
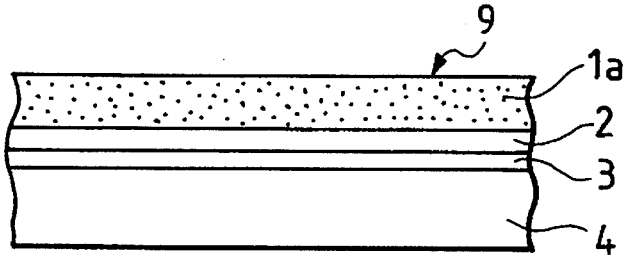
FIG. 8 is a cross-sectional view of a surface portion of a developing sleeve of a still further embodiment of the present invention.

FIG. 8 is a cross-sectional view of a surface portion of a developing sleeve of still another embodiment of the present invention. The sleeve 9 in this embodiment employs a sleeve-shaped ABS resin as the non-metallic member 4. A catalysis layer 3 and a metal-plating layer 2 are sequentially formed on the ABS resin by conducting the steps of applying metal-plating to plastic. Using the sleeve base thus prepared, an electrodeposition coating film 1*a* containing a metal-plated powdery ceramic and a powdery metal is formed on the surface of that sleeve base.

Figure 9:
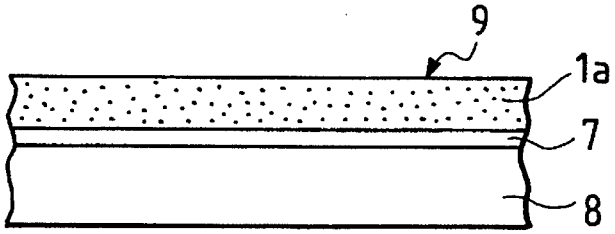
FIG. 9 is a cross-sectional view of a surface portion of a developing sleeve of a still another embodiment of the present invention.

FIG. 9 is a cross-sectional view of a surface portion of a developing sleeve of still another embodiment of the present invention. The sleeve 9 of this embodiment employs a sleeve-shaped iron material as the metallic member 8, and thereon, a chemical conversion coating layer 7 is formed. Using the sleeve base thus prepared, an electrodeposition coating film 1*a* containing a metal-plated powdery ceramic and a powdery metal is formed on the surface of that sleeve base.

An electrodeposition coating film 1*a* containing a metal-plated powdery ceramic and the powdery metal was formed in a thickness of 20 μm on one face of an aluminum 53S test piece (size: 5 cm long ×5 cm wide ×1.0 mm thick), and the volume resistivity of the film 1*a* was measured with a contact insulation resistance tester in the same manner as the aforementioned electrodeposition coating film 1 containing a metal-plated powdery ceramic. The result was similar to that shown in FIG. 4.

In the formation of the above electrodeposition coating film 1*a*, there were used a powdery metal composed of an ultrafine powdery metal having an average particle diameter of 0.3 μm and a powdery ceramic composed of powdery $Al_2O_3$ having an average particle diameter of 1 μm and having been plated thereon with nickel in a thickness of 0.1 μm. The powdery matter comprising the ultrafine powdery nickel and the powdery ceramic was mixed with a resin in a ratio of the resin to the powdery matter of 7:3 by weight to prepare an electrodeposition paint containing an acrylic resin at a content of 12% by weight. The volume resistivity was measured by bringing a 4-point contact type probe into contact with the electrodeposition coating film at a measuring area of 1 $cm^2$.

In the case where the ultrafine powdery nickel and the nickel-plated fine powdery $Al_2O_3$ are incorporated in the electrodeposition paint, the volume resistivity ρ of the obtained electrodeposition coating film 1*a* gradually changed with the change of the content of the metal-plated fine powdery $Al_2O_3$ in a similar manner as shown in FIG. 4. Accordingly, an any desired volume resistivity can be imparted accurately to the developing sleeve 9. Moreover, the electrodeposition coating film 1 is formed uniformly over the entire surface of the developing sleeve 9 since the coating is conducted by electrophoresis in the electrodeposition.

Figure 5:
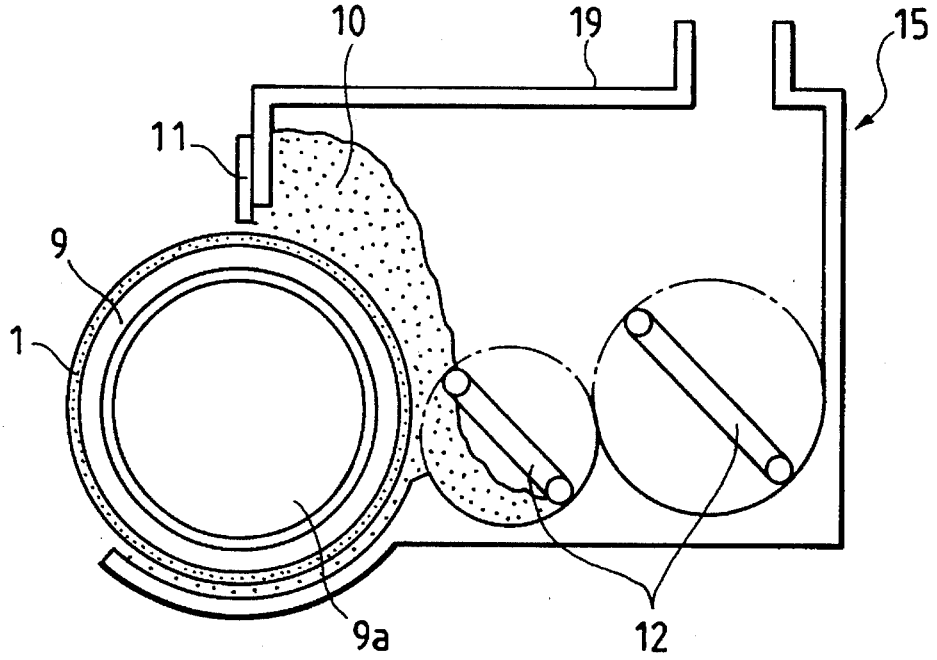
FIG. 5 illustrates schematically a developing device of the present invention employed in the durability test of the developing sleeve in examples of the present invention.

A developing apparatus for developing an electrostatic latent image is explained which employs the aforementioned developing sleeve of the present invention, with reference to FIG. 5.

Figure 6:
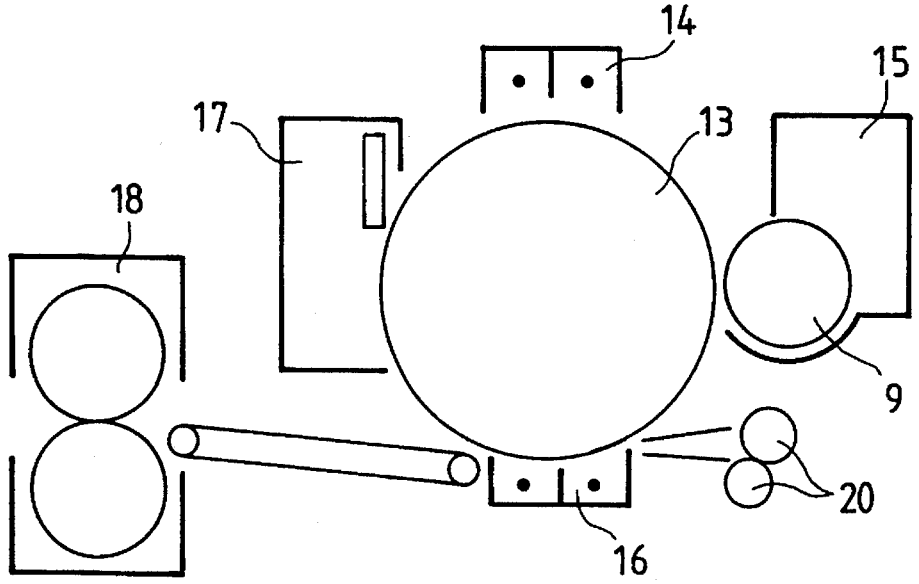
FIG. 6 illustrates schematically an image-forming apparatus employing a developing device shown in FIG. 5.

In the developing apparatus shown in FIG. 5, a magnetic toner 10 in a developing-agent container 19 equipped with two developing-agent delivering members 12 is supplied to a developing sleeve 9 by the developing-agent delivering member 12; the supplied toner 10 is held on the developing sleeve 9 by action of a non-rotating magnet roller 9*a* provided inside the developing sleeve 9; the toner 10 is delivered to a developing section facing a photosensitive drum shown in FIG. 6 with the thickness of the toner layer being controlled by a magnetic blade 11 provided above the sleeve 9; and a latent image formed on the photosensitive drum 13 is developed and visualized as a toner image.

The image-forming apparatus having the above-mentioned developing device of the present invention is equipped with the photosensitive drum 13, and forms an electrostatic latent image by electrifying the photosensitive drum 13 uniformly with a primary electrifier 14, and subsequently exposing the photosensitive drum 13 to an optical image with a light exposure means not shown in the drawing. The latent image formed on the photosensitive drum 13 is developed by the developing apparatus as a toner image. The toner image is transferred onto a transfer-receiving material (not shown in the drawing) fed through registration rollers 20 to the photosensitive drum 13 by a transfer electric field generated by a transfer-electrifier 16. The transfer-receiving material having received the toner image is sent to an image-fixing device 18 to fix the toner image as a permanent image, and is then sent out of the apparatus. The surface of the photosensitive drum 13 after the image transfer is cleaned with a cleaner 17 to remove the remaining toner for the next image formation.

The electrodeposition coating in the present invention is applied on a sleeve base with an electrodeposition paint composed of an electrodepositable resin containing a powdery electroconductivity-controlling agent, whereby a developing sleeve is provided which has a surface layer containing an electroconductivity-controlling agent dispersed uniformly, and has a satisfactorily roughened surface, and excellent properties of high abrasion resistance, well-controlled electroconductivity, excellent toner-delivering performance, and ease of imparting frictional electric charge.

In the case where the powdery electroconductivity-controlling agent is a powdery ceramic, the powdery ceramic disperses uniformly in the coating film to improve the coating film strength and the abrasion resistance.

In the case where the powdery electroconductivity-controlling agent is a powdery ceramic plated with a metal, a desired electroconductivity can be achieved using a smaller amount of the powdery material, and the electroconductivity is controlled easily with a smaller amount of the powdery matter in comparison with the case where the powdery ceramic is not plated with a metal.

In the case where the powdery electroconductivity-controlling agent is a combination of a powdery ceramic and a fine powdery metal, the structure of the coating film and the electroconductivity thereof are readily optimized by attaining the surface roughness of the developing sleeve with the powdery ceramic and by controlling the electroconductivity of the coating film with the powdery metal. Moreover, the such characteristics of the coating film is obtainable at a low cost by simply conducting electrodeposition with an electrodeposition paint containing the powdery ceramic and the powdery metal.

The present invention is explained in more detail by reference to Examples.

Preparation of Developing Sleeves A and B

Developing Sleeve A and Developing Sleeve B were prepared by forming, on a surface of an aluminum sleeve base, an electrodeposition coating film with co-deposition of a metal-plated powdery ceramic (plating thickness of 0.1 μm) as shown in Table 1. The electrodeposition paint was of an anion type and contained from 6 to 11 parts by weight of the powdery ceramic in 100 parts by weight of an acrylic resin. The electrodeposition coating film had a thickness of 10 μm. The liquid temperature was about 25° C. The curing of the coating film was conducted at 100° C. in an oven for 60 minutes.

Preparation of Developing Sleeves C to H

Developing Sleeves C to H were prepared in the same manner as Developing Sleeves A and B except for using a powdery ceramic without metal plating as shown in Table 1.

Preparation of Developing Sleeve I

Developing Sleeve I was prepared by sand-blasting a stainless steel member without formation of a coating film.

Preparation of Developing Sleeve J

Developing Sleeve J was prepared by sand-blasting an aluminum member without formation of a coating film.

Preparation of Developing Sleeve K

Developing Sleeve K was prepared in the same manner as Developing Sleeve A except that the surface coating layer was formed from the same paint by dipping treatment instead of electrodeposition.

Examples 1 to 8 and Comparative Examples 1 to 3

The Developing Sleeves A to K were each tested by setting them on the developing device 15 shown in FIG. 5 mounted on an image-forming apparatus 16 shown in FIG. 6, and conducting image formation. The outside diameters of the sleeves were made to be 32 mm unexceptionally.

Each developing sleeve 9 set on the developing device 15 was confirmed to give the same level of the initial image density. Then the developing sleeve was rotated for 100 hours without image formation with appropriate replenishment of the toner 10 (blank rotation). Thereafter, the developing sleeve was employed for image development. The durability of the developing sleeve was evaluated from the deterioration of the formed image density which will be caused by the abrasion of the developing sleeve 9. When the surface roughness of the developing sleeve 9 is lost by abrasion, the toner delivering property and electrification property are impaired, resulting in a lower image density. Table 1 shows the results. The blank rotation for 100 hours corresponds to passage of about 500,000 sheets of A4-sized paper in a 85 cpm (or sheets/min.) copying machine.

The results of the durability test were evaluated in Table 1 on four grades: "excellent" if the image density at the end of the test is the same as that of the initial image density; "good" if it is slightly lower but causes no trouble in practical use; "fair" if it is lower and causes a slight problem; and "poor" if it is not suitable for practical use.

Table 1 shows that the developing sleeves of Examples 1 to 8 had the same developing ability as the ones of Comparative Examples 1 and 2 in the initial image development and had higher durability than that of Comparative Examples.

Examples 9 and 10

Developing Sleeve L and M were prepared by forming an electrodeposition coating film on a surface of a sleeve base in the same manner as in Example 1 except that the sleeve base is made of iron (in Example 9), or an ABS resin (in Example 10) in place of aluminum in Example 1. The Developing Sleeves were tested for image formation in the same manner as in Example 1, and found that no deterioration of performance of the developing sleeves was observed and the results were the same as that in Example 1.

Example 11

A cylinder of 32 mm in outside diameter made of an ABS resin was used as the sleeve member. The ABS cylinder was etched with an etching solution of $CrO_3$-$H_2SO_4$-$H_2O$ type for one minute, then treated with a sensitizer solution containing 30 g/l of stannous chloride and 20 ml/l of hydrochloric acid for 2 minutes at room temperature, and treated for catalysis with palladium. Then electroless nickel plating was conducted to a plating thickness of 0.5 mm, and treated with a 0.01 g/l solution of chromic acid anhydride for one minute to obtain a sleeve base.

A metal-plated powdery matter was prepared by conducting electroless nickel plating in a thickness of 0.1 μm on a powdery alumina of an average particle diameter of 1 μm. Eight parts by weight of this nickel-plated powdery alumina was blended with 100 parts by weight of an acrylic-melamine resin (Honey Bright C-IL, trade name, made of Honey Kasei Co.), and the mixture was dispersed with a ball mill for 30 hours. The mixture was then diluted to 15% by weight with deionized water to obtain an electrodeposition paint.

This paint was applied by electrodeposition on the sleeve base as the anode with a 0.5 mm-thick stainless steel plate as the counter electrode at a bath temperature of 25° C., pH of 8 to 9, and voltage application of 100 to 150 V for 3 minutes.

After the electrodeposition, the sleeve was washed with water, and the deposited matter-was cured in an oven at a temperature of 97° C.±1° C. for 60 minutes to form a electrodeposition coating film to prepare Developing Sleeve N. The thickness of the electrodeposited coating film was 10 to 12 μm, and the content (amount of co-deposition) of the metal-plated powdery matter was 35 to 40% by weight.

This Developing Sleeve N having the electrodeposition coating film had the same level of surface roughness and the toner delivery ability as that of a stainless-steel developing sleeve just after blasting treatment. This Developing Sleeve N was set in a developing device shown in FIG. 5 and tested for durability in image formation with an image-forming apparatus of FIG. 6. The abrasion resistance was sufficiently high, and no deterioration of the developed image density was observed even after 100 hours of the blank rotation.

Example 12

An electrodeposition paint was prepared in the same manner as in Example 11 except that nickel was plated in a thickness of 0.1 μm on the surface of a powdery alumina of 1 μm in average diameter, and 4 parts by weight of the metal-plated powdery alumina was added to 100 parts by weight of the acrylic-melamine resin. The paint was applied on an ABS resin sleeve base by electrodeposition in the same manner as in Example 11 to prepare Developing Sleeve O. The thickness of the electrodeposition coating film was 10 to 12 μm, and the content of the powdery matter in the painted coating film was 23 to 28% by weight.

This Developing Sleeve O having the electrodeposition coating film had the same level of surface roughness as that of a stainless-steel developing sleeve just after blasting treatment, and the volume sleeve just after blasting treatment, and the volume resistivity of the coating film layer was $10^7$ to $10^9$ Ω•cm. This Developing Sleeve O was set in a developing device 15 shown in FIG. 5 and tested for durability in image formation with an image-forming apparatus of FIG. 6. The friction electrification charge was satisfactorily imparted to the toner for the development, and the developed image had sufficient density. This developing ability did not deteriorated by the durability test of 100 hours of the blank rotation.

Example 15

A sleeve base was prepared by working aluminum 53S into a cylinder of 32 mm in outside diameter, and forming thereon an alumire coating film of 3 μm thick by anodic oxidation.

A metal-plated powdery matter was prepared by applying electroless copper plating in a thickness of 0.1 μm on a powdery alumina of an average particle diameter of 1 μm. Four parts of this copper-plated alumina was blended with 100 parts by weight of an acrylic-melamine resin, and the mixture was dispersed with a ball mill for 30 hours. The mixture was then diluted to 15% by weight with deionized water to obtain an electrodeposition paint.

This paint was applied by electrodeposition onto the sleeve base as the anode with a 0.5 mm-thick bath temperature of 25° C., pH of 8 to 9, and voltage application of 100 to 150 V for 3 minutes.

After the electrodeposition, the sleeve was washed with water, and the deposited matter was cured in an oven at a temperature of 120° C.±1° C. for 50 minutes to form an electrodeposition coating film to prepare Developing Sleeve P. The thickness of the electrodeposited coating film was 10 to 12 μm, and the content of the metal-plated powdery matter was 33 to 38% by weight.

This Developing Sleeve P having the electrodeposition coating film had the same level of surface roughness as that of a stainless-steel developing sleeve just after blasting treatment. This Developing Sleeve P was tested for durability by blank rotation in the same manner as in Example 11. Consequently, sufficient image density was obtained by satisfactory development even after 100 hours of the blank rotation.

In the above Examples 11 to 13, no inconvenience was caused by thermal deformation of the developing sleeve because the ABS resin is not deformed at a temperature of not higher than 50° C., and aluminum has a high thermal conductivity.

As shown above, the developing sleeves of Examples 1 to 13, which have respectively an electrodeposition coating film 1 formed by co-deposition of a resin and a powdery ceramic and containing the powdery ceramic dispersed uniformly, have a satisfactorily roughened surface and have excellent properties of high abrasion resistance, well-controlled electroconductivity, excellent toner-delivering performance, and ease of frictional electrification. Accordingly, the sleeve of the present invention satisfies the requirement for high surface uniformity, and high abrasion resistance with a wide selection range of the sleeve base material and at a low production cost.

Preparation of Developing Sleeves AA and BB

Developing Sleeve AA and Developing Sleeve BB were prepared by forming, on a surface of an aluminum sleeve base, an electrodeposition coating film with co-deposition of a metal-plated powdery ceramic (plating thickness of 0.1 μm) and a powdery metal as shown in Table 2. The electrodeposition paint was of an anion type and contained from 6 to 11 parts by weight of the powdery ceramic in a 100 parts by weight of an acrylic resin. The electrodeposition coating film had a thickness of 10 μm. The liquid temperature was about 25° C. The curing of the coating film was conducted at 100° C. in an oven for 60 minutes.

Preparation of Developing Sleeves CC to HH

Developing Sleeves CC to HH were prepared in the same manner as Developing Sleeves AA and BB except that the powdery ceramic used was not plated with metal and the powdery metal was changed or not used as shown in Table 2.

Preparation of Developing Sleeve II

Developing Sleeve II was prepared by sand-blasting a stainless steel member without formation of a coating film.

Preparation of Developing Sleeve JJ

Developing Sleeve JJ was prepared by sand-blasting an aluminum member without formation of a coating film.

Preparation of Developing Sleeve KK

Developing Sleeve KK having a coating layer on the surface was prepared by dipping treatment using the same acrylic paint as used in the preparation of Developing Sleeve AA. The powdery matter content in the formed coating film was adjusted to be the same as the Developing Sleeve AA.

Examples 14 to 21 and Comparative Examples 4 to 6

The Developing Sleeves AA to KK were each tested by setting them on the developing device 15 shown in FIG. 5 mounted on an image-forming apparatus 16 shown in FIG. 6, and conducting image formation. The outside diameters of the sleeves were made to be 32 mm unexceptionally.

The developing sleeves 9 were evaluated in the same manner as in Example 1. Each developing sleeve 9 was set on the developing device 15. Then the developing sleeve was rotated for 100 hours without image formation with appropriate replenishment of the toner 10 (blank rotation). Thereafter, the developing sleeve was employed for image development. The durability of the developing sleeve was evaluated from the deterioration of the formed image density which will be caused by the abrasion of the developing sleeve 9. Table 2 shows the results.

The results of the durability test were evaluated in Table 2 on four grades of excellent, good, fair, and poor with the same standard as in Table 1.

Table 2 shows that the developing sleeves of Examples 14 to 21 containing an ultrafine powdery metal and a powdery ceramic had the same developing ability as the ones of Comparative Examples 3 and 4 in the initial image development and had higher durability than that of Comparative Examples 3 and 4, like the case of the developing sleeves of Examples 1 to 8 which contain a powdery ceramic alone in the electrodeposition coating film in Table 1.

Examples 22 and 23

Developing Sleeve LL and MM were prepared by forming an electrodeposition coating film on a surface of a sleeve base in the same manner as in Example 14 except that the sleeve base was made of iron (in Example 22), or an ABS resin (in Example 23) in place of aluminum in Example 14. The developing sleeves were tested for image formation in the same manner as in Example 14, and found that no deterioration of performance of the developing sleeves was observed and the results were the same as that in Example 14.

Example 24

A metal-plated powdery matter was prepared by conducting electroless nickel plating in a thickness of 0.1 μm on a powdery alumina of an average particle diameter of 1 μm. Eight parts by weight of this nickel-plated powdery alumina and 8 parts by weight of fine powdery cobalt having an average particle diameter of 0.3 μm were mixed with 100 parts by weight of an acrylic-melamine resin (Honey Bright C-IL, trade name), and the mixture was dispersed with a ball mill for 30 hours. The mixture was then diluted to 15% by weight with deionized water to obtain an electrodeposition paint.

This paint was applied by electrodeposition on the sleeve base as the anode with a 0.5 mm-thick stainless steel plate as the counter electrode at a bath temperature of 25° C., pH of 8 to 9, and voltage application of 100 to 150 V for 3 minutes. The sleeve base was the same treated ABS resin cylinder as in Example 11.

After the electrodeposition, the sleeve was washed with water, and the deposited matter was cured in an oven at a temperature of 97° C.±1° C. for 60 minutes to form a electrodeposition coating film to prepare Developing Sleeve NN. The thickness of the electrodeposited coating film was 10 to 12 μm, and the content (the co-deposition amount) of the metal-plated powdery alumina and the powdery metal was 35 to 40% by weight.

This Developing Sleeve NN having the electrodeposition coating film had the same surface roughness and the same toner delivery ability as that of a stainless-steel developing sleeve just after blasting treatment. This Developing Sleeve NN was set on a developing device shown in FIG. 5 and tested for durability in image formation with an image-forming apparatus of FIG. 6. The abrasion resistance was sufficiently high, and no deterioration of the developed image density was observed even after 100 hours of the blank rotation.

Example 25

An electrodeposition paint was prepared in the same manner as in Example 24 except that the powdery matter was replaced by 4 parts by weight of powdery alumina having average particle diameter of 1 μm and plated with nickel in a thickness of 0.1 μm and 5 parts by weight of fine powdery tungsten having an average particle diameter of 0.3 μm with respect to 100 parts by weight of the acrylic-melamine resin. The paint was applied on the same sleeve base as used in Example 24 by conducting electrodeposition in the same manner as in Example 24 to prepare Developing Sleeve OO. The thickness of the electrodeposition coating film as 10 to 12 μm, and the content of the powdery matter in the painted coating film was 23 to 28% by weight.

This Developing Sleeve OO having the electrodeposition coating film had the same level of surface roughness as that of a stainless-steel developing sleeve just after blasting treatment, and the volume resistivity of the coating film layer was $10^7$ to $10^9$ Ω•cm. This Developing Sleeve OO was set on a developing device 15 shown in FIG. 5 and tested for durability in image formation with an image-forming apparatus of FIG. 6. The friction electrification charge was satisfactorily imparted to the toner for the development, and the developed image had sufficient density. This developing ability did not deteriorated by the durability test of 100 hours of the blank rotation.

Example 26

A sleeve base was prepared by working aluminum 53S into a cylinder of 32 mm in outside diameter, and forming thereon an anodized aluminum coating film of 3 μm thick by anodic oxidation.

An electrodeposition paint was prepared in the same manner as in Example 24 except that the powdery matter was replaced by 4 parts by weight of powdery alumina having an average particle diameter of 1 μm and plated with nickel in a thickness of 0.1 μm and 12 parts by weight of powdery cobalt having an average particle diameter of 0.3 μm with respect to 100 parts by weight of the acrylic-melamine resin. A developing sleeve was prepared in the same manner as in Example 24 on the same sleeve base as in Example 11 by conducting electrodeposition under the same conditions as in Example 11. The thickness of the electrodeposited coating film was 10 to 12 μm, and the content of the powdery matter was 23 to 28% by weight.

This Developing Sleeve PP having the electrodeposition coating film had the same surface roughness as that of a stainless-steel developing sleeve just after blasting treatment. This Developing Sleeve PP was tested for durability by blank rotation in the same manner as in Example 24. Consequently, sufficient image density was obtained by satisfactory development even after 100 hours of the blank rotation.

In the above Examples 24 to 26 employing a sleeve member of an ABS resin or aluminum, no inconvenience was caused by thermal deformation of the developing sleeve.

As shown above, the developing sleeves of Examples 14 to 26, which have respectively an electrodeposition coating film 1*a* formed by co-deposition of a resin, a powdery ceramic, and an ultrafine powdery metal have a satisfactorily roughened surface containing a powdery ceramic and an ultrafine metal powdery metal uniformly dispersed therein and have excellent properties of high abrasion resistance, well-controlled electroconductivity, excellent toner-delivering performance, and ease of imparting frictional electric charge. Accordingly, the sleeve of the present invention satisfies the requirement for high surface uniformity, and high abrasion resistance at a low production cost.

TABLE 1

| | Developing sleeve | Powdery ceramic | Average particle diameter of powder (μm) | Metal for plating | Quality of developed image after duration test *1 |
|---|---|---|---|---|---|
| Example | | | | | |
| 1 | A | $Al_2O_3$ | 1.0 | Ni | Excellent |
| 2 | B | $Al_2O_3$ | 1.0 | Cu | Excellent |
| 3 | C | $Al_2O_3$ | 1.0 | None | Good |
| 4 | D | SiC | 1.0 | None | Good |
| 5 | E | $Si_3N_4$ | 1.0 | None | Good |
| 6 | F | TaC | 1.0 | None | Good |
| 7 | G | $SiO_2$ | 1.0 | None | Good |
| 8 | H | $Cr_2O_3$ | 1.0 | None | Good |
| Comparative Example | | | | | |
| 1 | I | Stainless steel member merely sand-blasted without coating film | | | Fair |
| 2 | J | Aluminum member merely sand-blasted without coating film | | | Poor |
| 3 | K | Acrylic resin member coated by dipping with paint used for Developing Sleeve A | | | *2 |

*1 Excellent: No change of developed image density by duration test
Good: Developed image density slightly becoming lower by duration test but no problem
Fair: Developed image density becoming lower by duration test, involving some problem
Poor: Not suitable for practical use
*2 The powdery ceramic was not sufficiently uniformly dispersed in the coating layer, and the developing performance became lower slightly by the duration test.

TABLE 2

| | Developing sleeve | Powdery metal | Average particle diameter of powdery metal (μm) | Powdery ceramic | Average particle diameter of powdery ceramic (μm) | Metal for plating | Quality of developed image after duration test *1 |
|---|---|---|---|---|---|---|---|
| Example | | | | | | | |
| 14 | AA | Ni | 0.3 | $Al_2O_3$ | 1.0 | Ni | Excellent |
| 15 | BB | Cu | 0.3 | $Al_2O_3$ | 1.0 | Cu | Excellent |
| 16 | CC | Ni | 0.3 | $Al_2O_3$ | 1.0 | None | Good |
| 17 | DD | Ni | 0.3 | SiC | 1.0 | None | Good |
| 18 | EE | Cu | 0.3 | $Si_3N_4$ | 1.0 | None | Good |
| 19 | FF | Cu | 0.3 | TaC | 1.0 | None | Good |
| 20 | GG | None | — | $SiO_2$ | 1.0 | None | Good |
| 21 | HH | None | — | $Cr_2O_3$ | 1.0 | None | Good |
| Comparative Example | | | | | | | |
| 4 | II | Stainless steel member merely sand-blasted without coating film | | | | | Fair |
| 5 | JJ | Aluminum member merely sand-blasted without coating film | | | | | Poor |
| 6 | KK | Acrylic resin member coated by dipping with paint used for Developing Sleeve AA | | | | | *2 |

*1 Excellent: No change of developed image density by duration test
Good: Developed image density slightly becoming lower by duration test but no problem
Fair: Developed image density becoming lower by duration test, involving some problem
Poor: Not suitable for practical use
*2 The powdery ceramic was not sufficiently uniformly dispersed in the coating layer, and the developing performance became lower slightly by the duration test.

What is claimed is:

1. A developing sleeve comprising a sleeve base and an electrodeposition coating film formed on the surface thereof, wherein the electrodeposition coating film has a thickness ranging from 7 to 15 μm, and contains an electrodepositable resin and an electroconductivity-controlling powdery matter having an average particle diameter ranging from 0.1 to 10.0 μm.

2. The developing sleeve according to claim 1, wherein the electrodepositable resin comprises a low-temperature curing resin.

3. The developing sleeve according to claim 1, wherein the electrodepositable resin comprises one or more of the resins selected from the group of acrylic-melamine resins, acrylic resins, epoxy resins, urethane resins, and alkyd resins.

4. The developing sleeve according to claim 1, wherein the electrodeposition coating film contains a powdery ceramic.

5. The developing sleeve according to claim 4, wherein the powdery ceramic has an average particle diameter ranging from 0.3 to 3.0 μm.

6. The developing sleeve according to claim 4, wherein the electrodeposition coating film is formed by electrodeposition of an electrodeposition paint prepared by mixing 5 to 20 parts by weight of the powdery ceramic with 100 parts by weight of an electrodepositable resin.

7. The developing sleeve according to claim 4, wherein the electrodeposition coating film contains the co-deposited powdery ceramic at a content ranging from 5 to 50% by weight.

8. The developing sleeve according to claim 4, wherein the electrodeposition coating film contains the co-deposited powdery ceramic at a content ranging from 20 to 40% by weight.

9. The developing sleeve according to claim 4, wherein the sleeve base comprises a sleeve-shaped metal member and an oxidation coating film formed thereon.

10. The developing sleeve according to claim 4, wherein the sleeve base comprises a sleeve-shaped metal member and a chemical conversion coating film formed thereon.

11. The developing sleeve according to claim 4, wherein the sleeve base comprises a sleeve-shaped non-metal member, a catalyst treatment layer, and a metal-plated coating layer formed thereon.

12. The developing sleeve according to claim 11, wherein the non-metal member is formed from a plastic material.

13. The developing sleeve according to claim 11, wherein the non-metal member is formed from one or more resins selected from the group of ABS resins, CF/ABS resins, modified PPE resins, modified PPO resins, and GF/PC resins.

14. The developing sleeve according to claim 4, wherein the electrodeposition coating film has a volume resistivity ranging from $10^4$ to $10^{13}$ Ω•cm.

15. The developing sleeve according to claim 4, wherein the electrodeposition coating film has a volume resistivity ranging from $10^5$ to $10^{12}$ Ω•cm.

16. The developing sleeve according to claim 4, wherein the electrodeposition coating film contains further a powdery metal.

17. The developing sleeve according to claim 16, wherein the powdery metal is composed of one or more of metals selected from the group of Ag, Co, Cu, Fe, Mn, Ni, Pd, Sn, and Te.

18. The developing sleeve according to claim 16, wherein the powdery metal has an average particle diameter ranging from 0.01 to 5.0 μm.

19. The developing sleeve according to claim 16, wherein the powdery metal has an average particle diameter ranging from 0.01 to 1.0 μm.

20. The developing sleeve according to claim 16, wherein the electrodeposition coating film is formed by electrodeposition of an electrodeposition paint prepared by mixing the powdery metal and the powdery ceramic in total amount of from 5 to 40 parts by weight with 100 parts by weight of an electrodepositable resin.

21. The developing sleeve according to claim 4, wherein the powdery ceramic is plated with a metal on the surface thereof.

22. The developing sleeve according to claim 21, wherein the metal for plating is selected from Ni, and Cu.

23. The developing sleeve according to claim 21, wherein the plated metal on the powdery ceramic has a thickness ranging from 0.05 to 0.9 μm.

24. The developing sleeve according to claim 21, wherein the plated metal on the powdery ceramic has a thickness ranging from 0.1 to 0.5 μm.

25. The developing sleeve according to claim 21, wherein the powdery ceramic has an average particle diameter ranging from 0.3 to 3.0 μm.

26. The developing sleeve according to claim 21, wherein the electrodeposition coating film is formed by electrodeposition of an electrodeposition paint prepared by mixing 5 to 20 parts by weight of the powdery ceramic with 100 parts by weight of an electrodepositable resin.

27. The developing sleeve according to claim 26, wherein the electrodepositable resin comprises a low-temperature curing resin.

28. The developing sleeve according to claim 26, wherein the electrodepositable resin comprises one or more of the resins selected from the group of acrylic-melamine resins, acrylic resins, epoxy resins, urethane resins, and alkyd resins.

29. The developing sleeve according to claim 21, wherein the electrodeposition coating film contains the co-deposited powdery ceramic at a content ranging from 5 to 50% by weight.

30. The developing sleeve according to claim 21, wherein the electrodeposition coating film contains the co-deposited powdery ceramic at a content ranging from 20 to 40% by weight.

31. The developing sleeve according to claim 21, wherein the sleeve base comprises a sleeve-shaped metal member and an oxidation coating film formed thereon.

32. The developing sleeve according to claim 21, wherein the sleeve base comprises a sleeve-shaped metal member and a chemical conversion coating film formed thereon.

33. The developing sleeve according to claim 21, wherein the sleeve base comprises a sleeve-shaped non-metal member, a catalyst treatment layer, and a metal-plated coating layer formed thereon.

34. The developing sleeve according to claim 33, wherein the non-metal member is formed from a plastic material.

35. The developing sleeve according to claim 33, wherein the non-metal member is formed from one or more resins selected from the group of ABS resins, CF/ABS resins, modified PPE resins, modified PPO resins, and GF/PC resins.

36. The developing sleeve according to claim 21, wherein the electrodeposition coating film has a volume resistivity ranging from $10^4$ to $10^{13}$ Ω•cm.

37. The developing sleeve according to claim 21, wherein the electrodeposition coating film has a volume resistivity ranging from $10^5$ to $10^{12}$ Ω•cm.

38. The developing sleeve according to claim 21, wherein the electrodeposition coating film contains further a powdery metal.

39. The developing sleeve according to claim 38, wherein the powdery metal is composed of one or more of metals selected from the group of Ag, Co, Cu, Fe, Mn, Ni, Pd, Sn, and Te.

40. The developing sleeve according to claim 38, wherein the powdery metal has an average particle diameter ranging from 0.01 to 5.0 μm.

41. The developing sleeve according to claim 38, wherein the powdery metal has an average particle diameter ranging from 0.01 to 1.0 μm.

42. The developing sleeve according to claim 38, wherein the electrodeposition coating film is formed by electrodeposition of an electrodeposition paint prepared by mixing the powdery metal and the powdery ceramic in total amount of from 5 to 40 parts by weight with 100 parts by weight of an electrodepositable resin.

43. A developing device for developing an electrostatic latent image, comprising a developing sleeve for holding a toner and delivering the toner to a developing section facing an image-holding member, the developing sleeve comprising a sleeve base and an electrodeposition coating film formed on the surface thereof, wherein the electrodeposition coating film has a thickness ranging from 7 to 15 μm, and contains an electrodeposition resin and an electroconductivity-controlling powdery matter having an average particle diameter ranging from 0.1 to 10.0 μm.

44. The developing device according to claim 43, wherein the electrodepositable resin comprises a low-temperature curing resin.

45. The developing device according to claim 44, wherein the electrodepositable resin comprises one or more of the resins selected from the group of acrylic-melamine resins, acrylic resin, epoxy resin, urethane resins, and alkyd resins.

46. The developing device according to claim 43, wherein the electrodeposition coating film contains a powdery ceramic.

47. The developing device according to claim 46, wherein the powdery ceramic has an average particle diameter ranging from 0.3 to 3.0 μm.

48. The developing device according to claim 46, wherein the electrodeposition coating film is formed by electrodeposition of an electrodeposition paint prepared by mixing 5 to 20 parts by weight of the powdery ceramic with 100 parts by weight of an electrodepositable resin.

49. The developing device according to claim 46, wherein the electrodeposition coating film contains the co-deposited powdery ceramic at a content ranging from 5 to 50% by weight.

50. The developing device according to claim 46, wherein the electrodeposition coating film contains the co-deposited powdery ceramic at a content ranging from 20 to 40% by weight.

51. The developing device according to claim 46, wherein the electrodeposition coating film has a volume resistivity ranging from $10^4$ to $10^{13}$ Ωcm.

52. The developing device according to claim 46, wherein the electrodeposition coating film further contains a powdery metal.

53. The developing device according to claim 52, wherein the powdery metal is composed of one or more of metals selected from the group consisting of Ag, Co, Cu, Fe, Mn, Ni, Pd, Sn, and Te.

54. The developing device according to claim 52, wherein the powdery metal has an average particle diameter ranging from 0.01 to 5.0 μm.

55. The developing device according to claim 52, wherein the powdery metal has an average particle diameter ranging from 0.01 to 1.0 μm.

56. The developing device according to claim 52, wherein the electrodeposition coating film is formed by electrodeposition of an electrodeposition paint prepared by mixing the powdery metal and the powdery ceramic in total amount of from 5 to 40 parts by weight with 100 parts by weight of an electrodepositable resin.

57. The developing device according to claim 46, wherein the powdery ceramic is plated with a metal on the surface thereof.

58. The developing device according to claim 57, wherein the metal for plating is selected from the group consisting of Ag, Ni, and Cu.

59. The developing device according to claim 57, wherein the plated metal on the powdery ceramic has a thickness ranging from 0.05 to 0.9 μm.

60. The developing device according to claim 57, wherein the plated metal on the powdery ceramic has a thickness ranging from 0.1 to 0.5 μm.

61. The developing device according to claim 57, wherein the powdery ceramic has an average particle diameter ranging from 0.3 to 3.0 μm.

62. The developing device according to claim 57, wherein the electrodeposition coating film is formed by electrodeposition of an electrodeposition paint prepared by mixing 5 to 20 parts by weight of the powdery ceramic with 100 parts by weight of an electrodepositable resin.

63. The developing device according to claim 57, wherein the electrodeposition coating film contains the co-deposited powdery ceramic at a content ranging from 5 to 50% by weight.

64. The developing device according to claim 57, wherein the electrodeposition coating film contains the co-deposited powdery ceramic at a content ranging from 20 to 40% by weight.

65. The developing device according to claim 57, wherein the electrodeposition coating film has a volume resistivity ranging from $10^4$ to $10^{13}$ Ωcm.

66. The developing device according to claim 57, wherein the electrodeposition coating film has a volume resistivity ranging from $10^5$ to $10^{12}$ Ωcm.

67. The developing device according to claim 57, wherein the electrodeposition coating film contains further a powdery metal.

68. The developing device according to claim 67, wherein the powdery metal is composed of one or more of metals selected from the group consisting of Ag, Co, Cu, Fe, Mn, Ni, Pd, Sn, and Te.

69. The developing device according to claim 67, wherein the powdery metal has an average particle diameter ranging from 0.01 to 5.0 μm.

70. The developing device according to claim 67, wherein the powdery metal has an average particle diameter ranging from 0.01 to 1.0 μm.

71. The developing device according to claim 67, wherein the electrodeposition coating film is formed by electrodeposition of an electrodeposition paint prepared by mixing the powdery metal and the powdery ceramic in total amount of from 5 to 40 parts by weight with 100 parts by weight of an electrodepositable resin.

72. An image-forming apparatus comprising an image-holding member for holding an electrostatic latent image, and a developing device for developing the electrostatic latent image held on the image-holding member, the developing device comprising a developing sleeve for holding atoner and delivering the toner to a developing section facing to an image-holding member, the developing sleeve comprising a sleeve base and an electrodeposition coating film formed on the surface thereof, wherein the electrodeposition coating film has a thickness ranging from 7 to 15 μm, and contains an electrodepositable resin and an electrocontrolling powdery matter having an average particle diameter ranging from 0.1 to 10.0 μm.

73. The image-forming apparatus according to claim 72, wherein the electrodepositable resin comprises a low-temperature curing resin.

74. The image-forming apparatus according to claim 72, wherein the electrodepositable resin comprises one or more of the resins selected from the group consisting of acrylic-melamine resins, acrylic resins, epoxy resins, urethane resins, and alkyd resins.

75. The image-forming apparatus according to claim 72, wherein the electrodeposition coating film contains a powdery ceramic.

76. The image-forming apparatus according to claim 75, wherein the powdery ceramic has an average particle diameter ranging from 0.3 to 3.0 μm.

77. The image-forming apparatus according to claim 75, wherein the electrodeposition coating film is formed by electrodeposition of an electrodeposition paint prepared by mixing 5 to 20 parts by weight of the powdery ceramic with parts by weight of an electrodepositable resin.

78. The image-forming apparatus according to claim 75, wherein the electrodeposition coating film contains the co-deposited powdery ceramic at a content ranging from 5 to 50% by weight.

79. The image-forming apparatus according to claim 75, wherein the electrodeposition coating film contains the co-deposited powdery ceramic at a content ranging from 20 to 40% by weight.

80. The image-forming apparatus according to claim 75, wherein the electrodeposition coating film has a volume resistivity ranging from $10^4$ to $10^{13}$ Ωcm.

81. The image-forming apparatus according to claim 75, wherein the electrodeposition coating film has a volume resistivity ranging from $10^5$ to $10^{12}$ Ωcm.

82. The image-forming apparatus according to claim 75, wherein the electrodeposition coating film further contains a powdery metal.

83. The image-forming apparatus according to claim 82, wherein the powdery metal is composed of one or more of metals selected from the group consisting of Ag, Co, Cu, Fe, Mn, Ni, Pd, Sn, and Te.

84. The image-forming apparatus according to claim 82, wherein the powdery metal has an average particle diameter ranging from 0.01 to 5.0 μm.

85. The image-forming apparatus according to claim 82, wherein the powdery metal has an average particle diameter ranging from 0.01 to 1.0 μm.

86. The image-forming apparatus according to claim 82, wherein the electrodeposition coating film is formed by electrodeposition of an electrodeposition paint prepared by mixing the powdery metal and the powdery ceramic in total amount of from 5 to 40 parts by weight with 100 parts by weight of an electrodepositable resin.

87. The image-forming apparatus according to claim 75, wherein the powdery ceramic is plated with a metal on the surface thereof.

88. The image-forming apparatus according to claim 87, wherein the metal for plating is selected from Ag, Ni, and Cu.

89. The image-forming apparatus according to claim 87, wherein the plated metal on the powdery ceramic has a thickness ranging from 0.05 to 0.9 μm.

90. The image-forming apparatus according to claim 87, wherein the plated metal on the powdery ceramic has a thickness ranging from 0.1 to 0.5 μm.

91. The image-forming apparatus according to claim 87, wherein the powdery ceramic has an average particle diameter ranging form 0.3 to 3.0 μm.

92. The image-forming apparatus according to claim 87, wherein the electrodeposition coating film is formed by electrodeposition of an electrodeposition paint prepared by mixing 5 to 20 parts by weight of the powdery ceramic with parts by weight of an electrodepositable resin.

93. The image-forming apparatus according to claim 87, wherein the electrodeposition coating film contains the co-deposited powdery ceramic at a content ranging from 5 to 50% by weight.

94. The image-forming apparatus according to claim 87, wherein the electrodeposition coating film contains the co-deposited powdery ceramic at a content ranging from 20 to 40% by weight.

95. The image-forming apparatus according to claim 87, wherein the electrodeposition containing film has a volume resistivity ranging from $10^4$ to $10^{13}$ Ωcm.

96. The image-forming apparatus according to claim 87, wherein the electrodeposition coating film has a volume resistivity ranging from $10^5$ to $10^{12}$ Ωcm.

97. The image-forming apparatus according to claim 87, wherein the electrodeposition coating film further contains a powdery metal.

98. The image-forming apparatus according to claim 87, wherein the powdery metal is composed of one or more of metals selected from the group consisting of Ag, Co, Cu, Fe, Mn, Ni, Pd, Sn, and Te.

99. The image-forming apparatus according to claim 87, wherein the powdery metal has an average particle diameter ranging from 0.01 to 5.0 μm.

100. The image-forming apparatus according to claim 87, wherein the powdery metal has an average particle diameter ranging from 0.01 to 1.0 μm.

101. The image-forming apparatus according to claim 87, wherein the electrodeposition coating film is formed by electrodeposition of an electrodeposition paint prepared by mixing the powdery metal are the powdery ceramic in total amount of from 5 to 40 parts by weight with 100 parts by weight of an electrodepositable resin.

* * * * *

UNITED STATES PATENT AND TRADEMARK OFFICE

CERTIFICATE OF CORRECTION

PATENT NO. : 5,563,690

DATED : October 8, 1996

INVENTORS : KEISUKE HASEGAWA ET AL.

It is certified that error appears in the above-identified patent and that said Letters Patent is hereby corrected as shown below:

ON TITLE PAGE

Item [54]: Title "LAYER" should read --LAYER,--.

COLUMN 1

Line 2, "LAYER" should read --LAYER,--.

COLUMN 11

Line 17, "matter-was" should read --matter was--;
Line 63, "Example 15" should read --Example 13--;
Line 66, "alumire" should read --alumite--.

COLUMN 19

Line 5, "from Ni," should read --from Ag, Ni,--.

UNITED STATES PATENT AND TRADEMARK OFFICE

CERTIFICATE OF CORRECTION

PATENT NO. : 5,563,690

DATED : October 8, 1996

INVENTORS : KEISUKE HASEGAWA ET AL.

It is certified that error appears in the above-identified patent and that said Letters Patent is hereby corrected as shown below:

COLUMN 22

Line 18, "with" should read --with 100--.

Signed and Sealed this

Twenty-fifth Day of February, 1997

*Attest:*

*Attesting Officer*

BRUCE LEHMAN

*Commissioner of Patents and Trademarks*